US008268122B2

(12) United States Patent
Walter et al.

(10) Patent No.: US 8,268,122 B2
(45) Date of Patent: Sep. 18, 2012

(54) PROCESS OF PRODUCING HIGH-YIELD PULP

(75) Inventors: Karin Susanne Maria Walter, Goteborg (SE); Eva Linnea Elisabeth Wackerberg, Goteborg (SE); Magnus Lars Paulsson, Goteborg (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 11/606,190

(22) Filed: Nov. 29, 2006

(65) Prior Publication Data

US 2007/0125507 A1 Jun. 7, 2007

Related U.S. Application Data

(60) Provisional application No. 60/742,032, filed on Dec. 2, 2005.

(51) Int. Cl.
*D21C 3/00* (2006.01)
*D21B 1/02* (2006.01)

(52) U.S. Cl. ..... 162/78; 162/70; 162/79

(58) Field of Classification Search ..... 162/70, 162/78, 79

See application file for complete search history.

(56) References Cited

U.S. PATENT DOCUMENTS

| | | | | |
|---|---|---|---|---|
| 3,085,039 | A * | 4/1963 | Gartner | 162/78 |
| 4,022,965 | A | 5/1977 | Goheen et al. | |
| 4,657,633 | A * | 4/1987 | Dwiggins | 162/65 |
| 4,849,053 | A | 7/1989 | Gentile, Jr. et al. | 162/76 |
| 5,034,096 | A | 7/1991 | Hammer et al. | |
| 5,244,541 | A * | 9/1993 | Minton | 162/28 |
| 5,356,517 | A | 10/1994 | Pedersen et al. | 162/72 |
| 6,258,207 | B1 | 7/2001 | Pan | 162/27 |
| 2005/0011622 | A1 * | 1/2005 | Sabourin | 162/26 |
| 2006/0278353 | A1 * | 12/2006 | Ding | 162/49 |
| 2007/0246177 | A1 * | 10/2007 | Marland et al. | 162/76 |

FOREIGN PATENT DOCUMENTS

| | | | |
|---|---|---|---|
| CA | 2230315 | A1 * | 8/1999 |
| EP | 0 494 519 | A1 | 7/1992 |
| EP | 0 902 119 | B1 | 3/1999 |
| EP | 1 668 180 | B1 | 6/2006 |
| GB | 1 505 076 | | 3/1978 |
| JP | 62-191588 | A | 8/1987 |
| JP | 10-501587 | A | 2/1998 |

(Continued)

OTHER PUBLICATIONS

Industrial Wastewater—Fenton's Reagent: Iron-catalyzed hydrogen peroxide [downloaded online from Internet Archive; www.h2o2/applications/industrialwastewater/fentonsreagent.html], Feb. 2, 2002 [downloaded Nov. 7, 2008], www.h2o2.com, whole document.*

(Continued)

*Primary Examiner* — Anthony Calandra
(74) *Attorney, Agent, or Firm* — Robert C. Morriss

(57) ABSTRACT

The present invention relates to a process for preparing a high-yield pulp comprising a) treating a lignocellulose containing material chemically by means of an oxidizing system comprising at least one non-enzymatic oxidant substantially free from ozone and chlorine dioxide and an activator at a pH from about 2 to about 6.5; and b) treating the lignocellulose containing material mechanically for a time sufficient to produce a high-yield pulp, wherein the lignocellulose containing material is chemically treated prior to and/or during any mechanical treatment stage, and wherein the lignocellulose containing material is not chemically treated at a pH from about 11.5 to about 14 between stages a) and b).

19 Claims, 4 Drawing Sheets

FOREIGN PATENT DOCUMENTS

Figure 1:
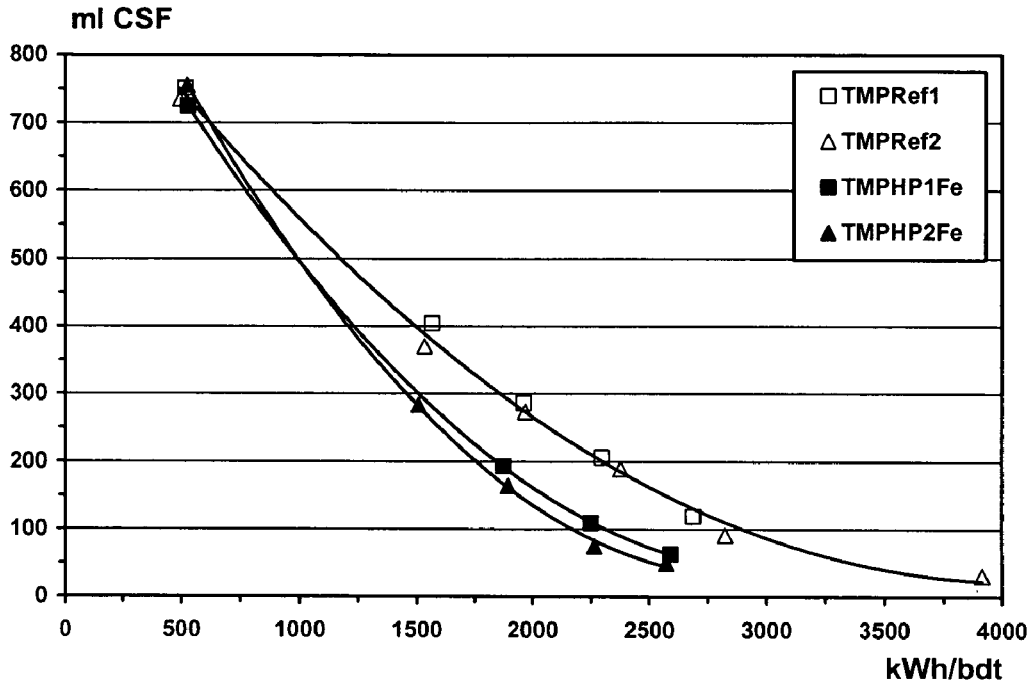

| | | | |
|---|---|---|---|
| WO | WO 87/01746 | A1 | 3/1987 |
| WO | WO 95/35407 | A1 | 12/1995 |
| WO | WO 97/22749 | A1 | 6/1997 |
| WO | WO 99/54544 | A1 | 10/1999 |
| WO | WO 03042451 | A2 * | 5/2003 |

OTHER PUBLICATIONS

Industrial Wastewater—Fenton's Reagent: Iron-catalyzed hydrogen peroxide [downloaded online from Internet Archive; www.h2o21applicationslindustrialwastewaterlfentonsreagent.html], Feb. 2, 2002 [downloaded Feb. 4, 2009], www.h2o2.com, whole document.*

Akzo Nobel, Notice of Opposition to EU Patent 1,668,180, Apr. 25, 2008, Akzo Nobel, whole document.*

Smook, Handbook for Pulp and Paper Technologists, 1992, Angus Wilde Publications, 2nd edition, chapters 4 and 5.*

Muenster et al., High Temperature LC/MC Refining Offers TMP Energy advantages, Jul. 2006, Pulp and Paper.*

Sundholm editor, Mechanical Pulping, 1999, Fapet Oy, p. 161, 351-358.*

The Engineering toolbox, Solids-Specific Heat Capcities, downloaded online Sep. 23, 2010.*

European Search Report for Application No. EP 05 11 1643 dated Jan. 30, 2006.

English language translation of JP 2008-543237 office action dated Apr. 19, 2011.

* cited by examiner

PROCESS OF PRODUCING HIGH-YIELD PULP

The present invention relates to a process for producing a high-yield pulp from a lignocellulose containing material.

BACKGROUND OF THE INVENTION

Enhanced production and efficient utilization of lignocellulosic products are issues of high importance to both the pulp and paper industry and society. The production of mechanical and chemimechanical pulps is an efficient way of using the world's natural resources since the yield of these manufacturing processes is high and the environmental impact is relatively low. Mechanical and chemimechanical pulping constitute about 25% of the total virgin fibre production in the world. One drawback with mechanical pulping processes is the high energy consumption that represents about 20% of the energy demand of papermaking in the world. The energy alone represents 25-50% of the total manufacturing cost of a thermomechanical pulp (TMP) depending on where in the world the mechanical pulp mill is located. In a TMP mill, about 80% of the energy is consumed during mainline refining (primary, secondary etc.), reject and low-consistency refining. The rest of the energy is consumed in pumps, agitators, screens, blowers, fans and mechanical drives. This means that most of the energy is used for fibre separation and for developing the fibres to make them suitable for the defined end-usage. It is therefore extremely important to find suitable ways of reducing the consumption of energy. However, a process that reduces the energy consumption during production of mechanical pulp is of limited interest for conventional products if the pulp or paper strength is, at the same time, substantially reduced or if the environmental effect is substantially impaired.

EP 494 519 A1 relates to a process comprising impregnating chips with an alkaline peroxide solution containing stabilizers for peroxide followed by mechanical defibration, in which the wood chips are pre-treated prior to peroxide impregnation. However, the process of EP 494 519 A1 involves extensive capital investment and does not result in sufficient energy saving with maintained pulp yield and pulp properties.

One object of the invention is to reduce the energy consumption in a process which is simple to install in a high-yield pulping process and without substantially reducing the fibre length or strength properties of the produced pulp. A further object of the present invention is to provide such a process while maintaining the pulp yield at an acceptable level. A further intention of the present invention is to provide a facilitated process without need of considerable capital investments. A further intention is to provide a process in the absence of alkaline treatment stages while improving or at least not substantially affecting properties of the obtained high-yield pulp, e.g. strength properties.

THE INVENTION

The present invention relates to a process for preparing a high-yield pulp comprising a) treating a lignocellulose containing material chemically by means of an oxidising system comprising at least one non-enzymatic oxidant substantially free from ozone and chlorine dioxide and an activator at a pH from about 2 to about 6.5; and b) treating the lignocellulose containing material mechanically for a time sufficient to produce a high-yield pulp, wherein the lignocellulose containing material is chemically treated prior to and/or during any mechanical treatment stage, and wherein the lignocellulose containing material is not chemically treated at a pH from about 11.5 to about 14 between stages a) and b).

According to one embodiment, the pH is from about 2.5 to about 6, for example from about 2.5 to about 5.5 or from about 3 to about 5.5 such as from about 3 to about 4. According to one embodiment, the pH is from about 3.5 to about 5.

According to one embodiment, the lignocellulose containing material is not chemically treated between stages a) and b) at a pH from about 7 to about 14, for example from about 8 to about 14 or from about 9 to about 14, e.g. from about 10 to about 14 or from about 10.5 to about 14 or from about 11 to about 14.

According to one embodiment, the lignocellulose containing material is not chemically treated before stage a) at a pH from about 7 to about 14, for example from about 8 to about 14 or from about 9 to about 14, e.g. from about 10 to about 14 or from about 10.5 to about 14 or from about 11 to about 14 or from about 11.5 to about 14.

The term high-yield pulp may comprise e.g. mechanical pulp (MP), refiner mechanical pulp (RMP), pressurized refiner mechanical pulp (PRMP), thermomechanical pulp (TMP), thermomechanical chemical pulp (TMCP), high-temperature TMP (HT-TMP) RTS-TMP, Thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW), chemimechanical pulp (CMP), chemirefinermechanical pulp (CRMP), chemithermomechanical pulp (CTMP), high-temperature CTMP (HT-CTMP), sulphite-modified thermomechanical pulp (SMTMP), reject CTMP ($CTMP_R$), groundwood CTMP (G-CTMP), semichemical pulp (SC), neutral sulphite semi chemical pulp (NSSC), high-yield sulphite pulp (HYS), biomechanical pulp (BRMP), pulps produced according to the OPCO process, explosion pulping process, Bi-Vis process, dilution water sulfonation process (DWS), sulfonated long fibres process (SLF), chemically treated long fibres process (CTLF), long fibre CMP process (LFCMP) or any modifications and combinations thereof. According to one embodiment, the high-yield pulp has a yield of at least about 60%, for example at least about 70%, or at least about 80%, or at least about 85%. According to one embodiment, the high-yield pulp has a yield of at least about 90% such as at least about 95%. The pulp may be a bleached or non-bleached pulp.

According to one embodiment, the lignocellulose containing material comprises non-defibrated wood. According to one embodiment, the lignocellulose containing material comprises mechanically treated lignocellulose containing material. According to one embodiment, the oxidising system is applied between two mechanical treatment stages. The lignocellulose containing material may comprise e.g. wood logs, finely-divided raw materials, including woody materials, such as wood particles (e.g. in the form of wood chips, wood shavings, wood fibres and saw dust) and fibres of annual or perennial plants including non-wood. The woody raw material can be derived from hardwood or softwood species, such as birch, beech, aspen such as European aspen, alder, eucalyptus, maple, acacia, mixed tropical hardwood, pine such as loblolly pine, fir, hemlock, larch, spruce such as Black spruce or Norway spruce, and mixtures thereof. Non-wood plant raw material can be provided from e.g. straws of grain crops, reed canary grass, reeds, flax, hemp, kenaf, jute, ramie, sisal, abaca, coir, bamboo, bagasse or combinations thereof.

According to one embodiment, the oxidant is selected from peroxy compounds, halogen containing oxidants, oxygen, nitrogen oxides or combinations thereof. The oxidising system, including the non-enzymatic oxidant, being substantially free from ozone can be advantageous due to the fact that ozone does not provide a sufficient pulp yield due to low selectivity and is usually a more expensive alternative. By the term "substantially free from ozone" is meant that the oxidising system comprises less than 5 wt %, for example less than 2 wt % or less than 1 wt % ozone (calculated as 100%) based on the total weight of the oxidising system. By the term "substantially free from chlorine dioxide" is meant that the oxidising system comprises less than 5 wt %, or less than 2 wt % or less than 1 wt % chlorine dioxide (calculated as 100%) based on the total weight of oxidising system.

According to one embodiment, the non-enzymatic oxidant and the activator can be added at any position prior to or during any mechanical treatment stage. According to one embodiment, the oxidising system is applied to the lignocellulose containing material at one or several stages before or during mechanical treatment. According to one embodiment, the oxidising system is applied as an inter-stage treatment between two mechanical treatment stages. According to one embodiment, the process uses two or three mechanical treatment stages such as refining stages between which treatment of the lignocellulose containing material can be performed with the oxidising system. However, any other number of stages may also be used including one or several reject refining stages. According to one embodiment, the oxidising system is applied to a reject refining stage.

The activator may be any suitable substance capable of accelerating the oxidation in the presence of a non-enzymatic oxidant. According to one embodiment, the activator is selected from metal ions, TAED, cyanamide, cupper sulfate, iron sulfate, and mixtures thereof. According to one embodiment, the activator is a transition metal.

According to one embodiment, the oxidising system comprises an enhancer that facilitates/controls the oxidation. According to one embodiment, the enhancer is selected from nitrogen-containing polycarboxylic acids, nitrogen-containing polyphosphonic acids, nitrogen-containing polyalcohols, oxalic acid, oxalate, glycolate, ascorbic acid, citric acid nitrilo acetate, gallic acid, fulvic acid, itaconic acid, haemoglobin, hydroxybenzenes, catecholates, quinolines, dimethoxybenzoic acids, dihydroxybenzoic acids, dimethoxybenzylalcohols, pyridine, histidylglycine, phthalocyanine, acetonitrile, 18-crown-6-ether, mercaptosuccinic acid, cyclohexadienes, polyoxomethalates, and combinations thereof.

According to one embodiment, the enhancer is selected from nitrogen-containing organic compounds, primarily nitrogen-containing polycarboxylic acids, nitrogen-containing polyphosphonic acids, nitrogen-containing polyalcohols, and mixtures thereof. According to one embodiment, the enhancer is selected from diethylenetriaminepentaacetic acid (DTPA), ethylenediaminetetraacetic acid (EDTA), nitrilotriacetic acid (NTA), and combinations thereof. According to one embodiment, the enhancer is selected from compounds based on other aminopolycarboxylic acids, polyphosphates or polyphosphonic acids, hydroxycarboxylates, hydrocarboxylic acids, dithiocarbamate, oxalic acid, iminodisuccinic acid, [S,S']-etylenediaminedisuccinic acid, glycolate, ascorbic acid, citric acid, nitrilo acetate, gallic acid, fulvic acid, itaconic acid. According to one embodiment, the enhancer is selected from oxalate, haemoglobin, dihydroxybenzene (e.g. hydroquinone), trihydroxybenzene, catecholates (e.g. 4,5-dimethoxycatechol, 2,3 dihydroxy-benzene, 4-methyl catechol), quinoline, hydroxyquinoline (e.g. 8-hydroxyquinoline), dihydroxybenzoic acid (e.g. 3,4-dihydroxybenzoic acid, 2,3-dihydroxybenzoic acid), 3,4-dimethoxybenzylalcohol, 3,4-dimethoxybenzoic acid, 3,4-dimethoxy toluene, pyridine, histidylglycine, phthalocyanine, acetonitril, 18-crown-6 ether, mercaptosuccinic acid, 1,3-cyclohexadiene, polyoxomethalates. According to one embodiment, the oxidising system comprises as an enhancer also at least one enzyme.

According to one embodiment, the lignocellulose containing material is treated with the oxidising system for from about one second to about ten hours. According to one embodiment, the lignocellulose containing material is treated with the oxidising system for from about five seconds to about five hours. According to one embodiment, the lignocellulose containing material is treated with the oxidising system for from about ten seconds to about three hours.

According to one embodiment, the lignocellulose containing material is treated at a temperature from about 30 to about 200° C. According to one embodiment, the lignocellulose containing material is treated at a temperature from about 50 to about 180° C. According to one embodiment, the lignocellulose containing material is treated at a temperature from about 80 to about 180° C.

According to one embodiment, the non-enzymatic oxidant (calculated as 100%) is added in an amount from about 0.1 to about 5 wt % based on the weight of the lignocellulose containing material. According to one embodiment, the non-enzymatic oxidant (calculated as 100%) is added in an amount from about 0.2 to about 3 wt % based on the weight of the lignocellulose containing material. According to one embodiment, the non-enzymatic oxidant (calculated as 100%) is added in an amount from about 0.3% to about 2 wt % based on the weight of the lignocellulose containing material.

According to one embodiment, an activator (calculated as 100%) is added in an amount from about 0.0001 to about 1 wt % based on the weight of the lignocellulose containing material. According to one embodiment, an activator (calculated as 100%) is added in an amount from about 0.001 to about 0.5 wt % based on the weight of the lignocellulose containing material. According to one embodiment, an activator (calculated as 100%) is added in an amount from about 0.0025 to about 0.1 wt % based on the weight of the lignocellulose containing material. According to one embodiment, an activator is added prior to or during any mechanical treatment stage, either separately or simultaneously with a non-enzymatic oxidant. The activator may thus be added either before, simultaneously or after the addition of a non-enzymatic oxidant. This may be just before the addition of a non-enzymatic oxidant before a mechanical treatment stage such as a refiner, but may also be before e.g. a primary refiner whereas the non-enzymatic oxidant is added after the primary refiner but before a secondary refiner.

According to one embodiment, an enhancer (calculated as 100%) is added in an amount from about 0.001 to about 1 wt % based on the weight of lignocellulose containing material.

According to one embodiment, an enhancer (calculated as 100% pure compound) is added in an amount from about 0.01 to about 0.5 wt % based on the weight of the lignocellulose containing material. According to one embodiment, an enhancer (calculated as 100%) is added in an amount from about 0.05 to about 0.3 wt % based on the weight of the lignocellulose containing material. According to one embodiment, an enhancer is added prior to or during any mechanical treatment stage, either separately or simultaneously with a non-enzymatic oxidant and optionally an activator. The enhancer may thus be added either before, simultaneously or after the addition of a non-enzymatic oxidant. This may be just before the addition of the non-enzymatic oxidant before a mechanical treatment stage such as a refiner, but may also be before e.g. a primary refiner whereas the non-enzymatic oxidant is added after the primary refiner but before a secondary refiner.

The mechanical treatment may be performed in one or several stages. Typically, the mechanical treatment may be performed in two stages or more including a reject mechanical treatment stage where up to 60 wt % of the lignocellulose containing material may be passed through. The mechanical treatment stages usually are performed by passing the lignocellulose containing material through grinders, and/or refiners. However, other mechanical treatments may also be performed in equipments as, e.g. plug screws (e.g. impressafiner), roller mills (e.g. Szego mill), double shaft extruders (Bi-Vis screw extruder), the reciprocating apparatus, RT Fiberizer™, dispersers or in any combinations thereof.

According to one embodiment, the non-enzymatic oxidant is selected from inorganic peroxy compounds such as hydrogen peroxide or hydrogen peroxide generating compounds such as salts of percarbonate, perborate, peroxysulfate, peroxyphosphate, peroxysilicate or corresponding weak acids.

According to one embodiment, the non-enzymatic oxidant is selected from organic peroxy compounds such as peroxy carboxylic acids, e.g. peracetic acid and perbenzoic acid.

According to one embodiment, the oxidising system comprises halogen containing oxidants such as chlorite, hypochlorite, chloro sodium salt of cyanuric acid. According to one embodiment, the oxidising system comprises oxygen and/or nitrogen oxides such as NO or $NO_2$. According to one embodiment, the oxidizing system comprises combinations of different oxidants, which can be either added or re-used from the process steps which generate the non-enzymatic oxidants.

According to one embodiment, the oxidising system further comprises activators such as metal ions, e.g. Fe, Mn, Co, Cu, W or Mo, or TAED, cyanamide or combinations thereof. According to one embodiment, metal ions such as transistion metal ions may be used in the form of acids or salts or complexes with common organic or inorganic compounds.

According to one embodiment, ultraviolet radiation or other radiation is applied to the non-enzymatic oxidant or to the lignocellulose containing material being treated with the non-enzymatic oxidant, optionally in combination with an enhancer.

According to one embodiment, enhancers, e.g. complexing agents, chelating agents or ligands are comprised in the oxidising system. These enhancers may facilitate/control the oxidising effect depending on the amount thereof being added.

According to one embodiment, both an enhancer and an activator are comprised in the oxidising system.

The following examples will illustrate how the described invention may be performed without limiting the scope of it.

All parts and percentages refer to part and percent by bone dry weight, if not otherwise stated. The chemicals are calculated as 100%.

EXAMPLE 1

Black spruce (*Picea mariana*) wood was used for the production of thermomechanical pulp (TMP). The wood logs were debarked and chipped and washed prior to preheating (4.14 bar steaming pressure, 40 s retention time) and refining operations. A three-stage refining setup was used and the energy input was varied in the last refining stage to obtain pulps with different freeness (refining) levels. A single disc 36" pressurized refiner (model 36-1CP run at 1800 rpm) was used in the first refining stage and a double disc 36" atmospheric refiner (model 401, 1200 rpm) in the second and third stages. The energy input in the primary refiner was about 500 kWh/bone dry metric ton (bdmt) and in the second refining stage approximately 1000 kWh/bdmt. In most cases, three tertiary refining stages with a targeted energy input of 400, 800 and 1200 kWh/bdmt were performed. All trials were run at constant conditions which mean that the variation in specific energy consumption and pulp and paper properties is a result of the chemicals added during the trials. The energy consumption measured in the pilot plant for the references ($TMP_{Ref}$, and $TMP_{Ref}$, see tables and figures below) is comparable to commercial operation.

Each refining series described in the following examples was produced according to the procedure described above.

A TMP reference ($TMP_{Ref1}$ in figures and tables below) was produced without addition of chemicals. The degree of refining (freeness) as a function of the specific energy consumption (SEC) can be seen in FIG. 1 and the strength of the resulting pulp in Tables 1 and 2. FIG. 2 shows the fibre length distribution and FIG. 3 the fibre width distribution of the resulting pulp (freeness of approximately 100 ml CSF).

A TMP reference produced under more acidic conditions (denoted $TMP_{Ref2}$) was also provided to make sure that the energy reduction obtained is a consequence of the method described in the present invention and not an effect of lowering the pH during refining. The pH was lowered by adding 0.19 wt % sulphuric acid ($H_2SO_4$) based on the weight of bone dry wood to the refiner eye (inlet) of the primary refiner. The pH of the resulting pulp was 3.8. The TMP properties of the produced pulp can be found in FIGS. 1-3 and Tables 1-2 below.

A TMP manufactured according to the present invention using acid hydrogen peroxide ($H_2O_2$) was produced by adding 0.08 wt % iron sulfate ($FeSO_4 \times 7\ H_2O$) based on the weight of bone dry wood to the refiner eye of the primary refiner and 1.0 wt % hydrogen peroxide ($H_2O_2$) based on the weight of bone dry wood to the blow line of the primary refiner. The pH of the resulting pulp was 3.6. The pulp is denoted $TMP_{HP1Fe}$ in figures and tables below.

A second TMP manufactured according to the present invention using acid hydrogen peroxide ($H_2O_2$) was produced by adding 0.15 wt % (of bone dry wood) iron sulfate ($FeSO_4 \times 7\ H_2O$) to the refiner eye of the primary refiner and 1.1 wt % (of bone dry wood) hydrogen peroxide ($H_2O_2$) to the blow line of the primary refiner. The pH of the resulting pulp was 3.4. The pulp is denoted $TMP_{HP2Fe}$ in FIGS. 1-3 and Tables 1-2 below.

The degree of refining, measured as the freeness value of a pulp, is the most important parameter that influences pulp and paper properties such as strength and light scattering ability. It is therefore necessary to compare pulps at a constant freeness value. Both measured and interpolated values (to freeness 100 ml CSF) are thus provided in the text below.

Figure 2:
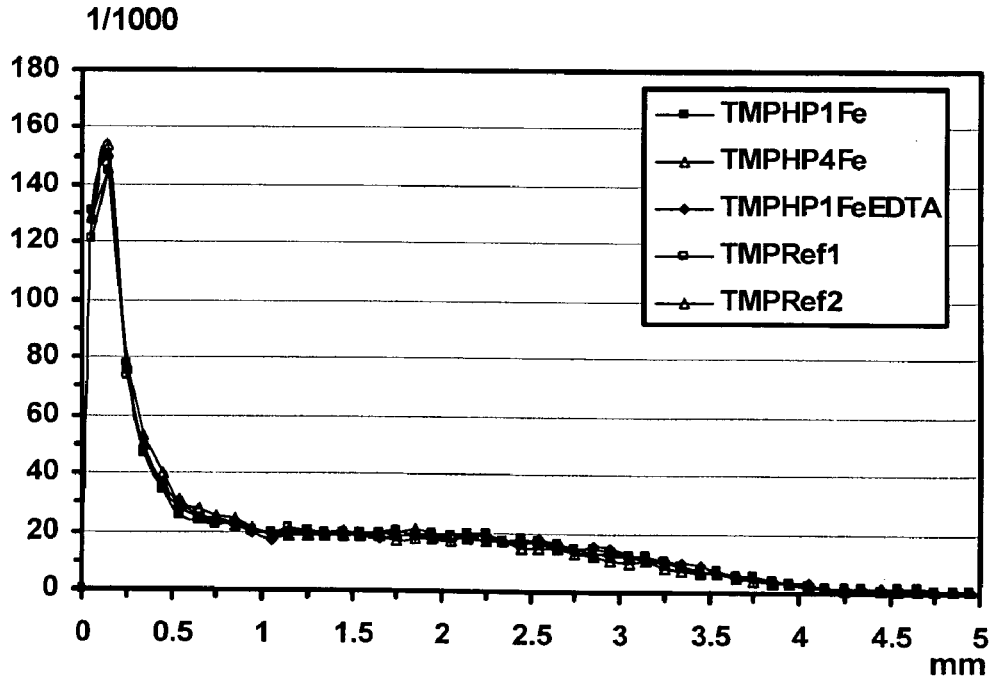

FIG. 1 illustrates the freeness as a function of the specific energy consumption (SEC) for the references ($TMP_{Ref1}$ and $TMP_{Ref2}$) and the pulps produced according to the invention ($TMP_{HP1Fe}$ and $TMP_{HP2Fe}$). It is evident from FIG. 1 that a substantial energy saving is obtained for the pulps produced according to the invention whereas there was no significant difference between the $TMP_{Ref1}$ and $TMP_{Ref2}$ when it comes to energy consumption. The pulps produced according to the invention consume 20% ($TMP_{HP1Fe}$) and 25% ($TMP_{HP2Fe}$) less energy to a constant freeness level (100 ml CSF) when compared to the energy consumption of the references ($TMP_{Ref1}$ and $TMP_{Ref2}$, see Table 2). The energy saving for $TMP_{HP1Fe}$ and $TMP_{HP2Fe}$ was obtained with 1.0 and 1.1 wt % (on bone dry wood) $H_2O_2$, respectively.

Moreover, it is also evident that the strength properties (tensile and burst index, TEA) of the pulps prepared according to the invention ($TMP_{HP1Fe}$ and $TMP_{HP2Fe}$) are similar to the strength properties of the TMP references (see Tables 1 and 2).

TABLE 1

The pulp characteristics and energy consumption of the produced pulps

| | Freeness (ml CSF) | Energy comsumption (kWh/bdt) | Tensile index (Nm/g) | Burst index ($kPam^2/g$) | TEA ($J/m^2$) | Fibre length[1] (mm) |
|---|---|---|---|---|---|---|
| $TMP_{Ref1}$ | 119 | 2687 | 42.4 | 2.6 | 30.4 | 1.6 |
| $TMP_{Ref2}$ | 91 | 2825 | 54.0 | 3.2 | 54.0 | 1.5 |
| $TMP_{HP1Fe}$[2] | 109 | 2250 | 44.3 | 2.9 | 34.3 | 1.6 |
| $TMP_{HP2Fe}$[2] | 75 | 2265 | 54.2 | 3.0 | 46.0 | 1.5 |

[1]The average (length weighted) fibre length was measured with the Kajaani FS-100 fibre size analyzer.
[2]Produced according to the invention.

TABLE 2

The pulp characteristics and energy savings of the produced pulps interpolated to a constant freeness value (100 ml CSF)

| | Energy saving[1] (%) | Tensile index (Nm/g) | Burst index ($kPam^2/g$) | TEA ($J/M^2$) | Fibre length[2] (mm) |
|---|---|---|---|---|---|
| $TMP_{Ref1}$ | | 49.5 | 2.7 | 32.3 | 1.6 |
| $TMP_{Ref2}$ | | 54.3 | 3.2 | 54.0 | 1.6 |
| $TMP_{HP1Fe}$[3] | 20 | 50.7 | 3.0 | 40.3 | 1.6 |
| $TMP_{HP2Fe}$[3] | 25 | 51.1 | 2.8 | 42.6 | 1.5 |

[1]The energy saving is given relative to the energy consumption of the TMP references ($TMP_{Ref1}$ and $TMP_{Ref2}$).
[2]The average (length weighted) fibre length was measured with the Kajaani FS-100 fibre size analyzer.
[3]Produced according to the invention.

One way of reducing the energy consumption is to cut the fibres during refining. However, one of the most important features during production of chemimechanical or mechanical pulps like e.g. TMP is to retain the fibre length to the greatest possible extent. Normally, a high average fibre length gives a pulp with good potential to produce strong papers. As seen in Tables 1 and 2, the average fibre length of the references ($TMP_{Ref1}$ and $TMP_{Ref2}$) and the pulps produced according to the invention ($TMP_{HP1Fe}$ and $TMP_{HP2Fe}$) was maintained. This is further elucidated in FIG. 2 which shows the fibre length distribution of $TMP_{Ref1}$, $TMP_{Ref2}$ and selected pulps from Examples 1-3 produced according to the invention and in FIG. 3 which shows the fibre width distribution for the same pulps measured with the FibreMaster instrument. The freeness values of the pulps are given in Tables 1, 3 and 5. Thus, the method according to the invention makes it possible to produce a high-yield pulp with much lower energy consumption without destroying the strength properties of the pulp.

EXAMPLE 2

Black spruce (*Picea mariana*) thermomechanical pulp (TMP) was debarked, chipped, preheated, and refined according to the procedure described in Example 1 above.

A TMP reference (denoted $TMP_{Ref1}$) was produced without addition of chemicals in the same manner as was described in Example 1.

A reference TMP produced under more acidic conditions (denoted $TMP_{Ref2}$) was produced by adding 0.19 wt % sulphuric acid ($H_2SO_4$) based on the weight of bone dry wood to the refiner eye (inlet) of the primary refiner in the same manner as was described in Example 1.

A TMP produced according to the present invention using acid hydrogen peroxide ($H_2O_2$) was produced by mixing 0.12 wt % $Na_4EDTA$ based on the weight of bone dry wood and 0.08 wt % iron sulfate ($FeSO_4 \times 7\ H_2O$) based on the weight of bone dry wood and then adding the mixture to the refiner eye of the primary refiner. Hydrogen peroxide ($H_2O_2$, 1.1 wt % based on the weight of bone dry wood) was added to the blow line of the primary refiner. The pH of the resulting pulp was 3.7. The pulp is denoted $TMP_{HP1FeEDTA}$ in FIGS. 2-4 and Tables 3-4.

The degree of refining, measured as the freeness value of the pulp, is the most important parameter that influences pulp and paper properties such as strength and light scattering ability. It is therefore necessary to compare pulps at a constant freeness value. Both measured and interpolated values (to freeness 100 ml CSF) are thus provided in the figures and tables.

Figure 4:
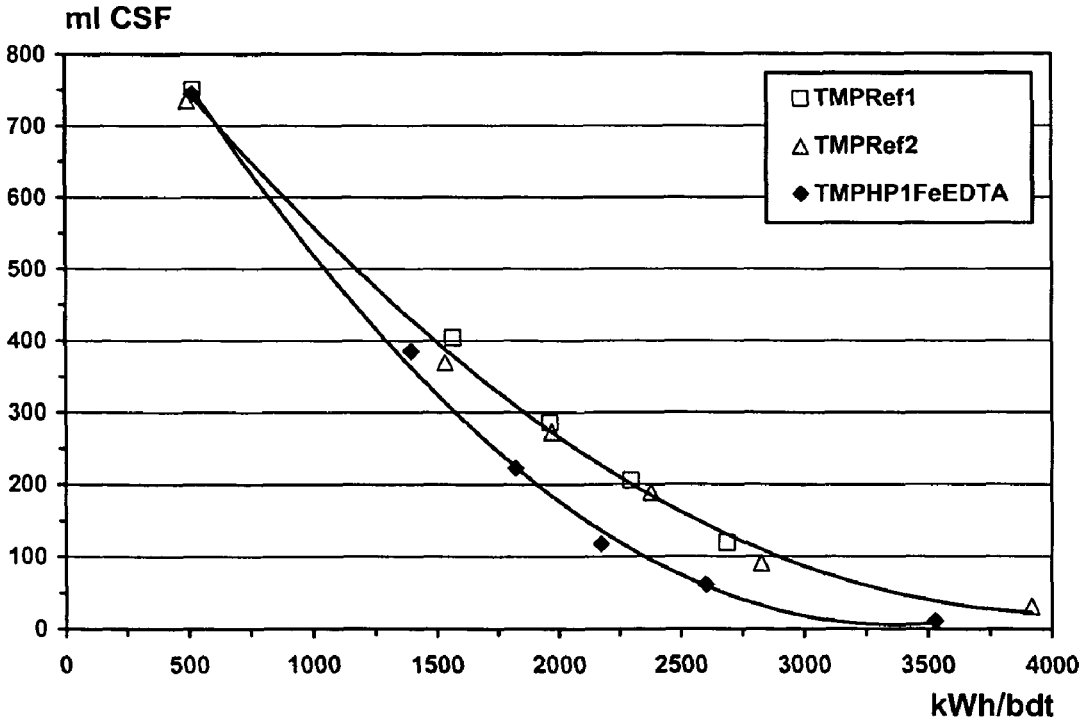

FIG. 4 illustrates freeness as a function of the specific energy consumption (SEC) for the TMP references ($TMP_{Ref1}$, and $TMP_{Ref2}$) and $TMP_{HP1FeEDTA}$ produced according to the invention. $TMP_{HP1FeEDTA}$ consumes 19% less energy to a constant freeness value (100 ml CSF) compared to the energy consumption of the references TMPs ($TMP_{Ref1}$, and $TMP_{Ref2}$, see Table 4).

TABLE 3

The pulp characteristics and energy consumption of the produced pulps

| | Freeness (ml CSF) | Energy consumption (kWh/bdt) | Tensile index (Nm/g) | Burst index ($kPam^2/g$) | TEA ($J/m^2$) | Fibre length[1] (mm) | Light scattering coefficient ($m^2/kg$) |
|---|---|---|---|---|---|---|---|
| $TMP_{Ref1}$ | 119 | 2687 | 42.4 | 2.6 | 30.4 | 1.6 | 53.2 |
| $TMP_{Ref2}$ | 91 | 2825 | 54.0 | 3.2 | 54.0 | 1.5 | 53.1 |
| $TMP_{HP1FeEDTA}$[2] | 118 | 2173 | 52.0 | 2.9 | 51.6 | 1.6 | 54.4 |
| $TMP_{HP1Fe}$[2,3] | 109 | 2250 | 44.3 | 2.9 | 34.3 | 1.6 | 49.4 |

[1]The average (length weighted) fibre length was measured with the Kajaani FS-100 fibre size analyzer.
[2]Produced according to the invention.
[3]Data taken from Table 1.

TABLE 4

The pulp characteristics and energy savings of the produced pulps interpolated to a constant freeness value (100 ml CSF)

| | Energy saving[1] (%) | Tensile index (Nm/g) | Burst index ($kPam^2/g$) | TEA ($J/m^2$) | Fibre length[2] (mm) | Light scattering coefficient ($m^2/kg$) |
|---|---|---|---|---|---|---|
| $TMP_{Ref1}$ | | 49.5 | 2.7 | 32.3 | 1.6 | 54 |
| $TMP_{Ref2}$ | | 54.3 | 3.2 | 54.0 | 1.6 | 52 |
| $TMP_{HP1FeEDTA}$[3] | 19 | 53.5 | 2.9 | 49.1 | 1.6 | 55 |
| $TMP_{HP1Fe}$[3,4] | 20 | 50.7 | 3.0 | 40.3 | 1.6 | 49 |

[1]The energy saving is given relative to the energy consumption of the TMP references ($TMP_{Ref1}$ and $TMP_{Ref2}$).
[2]The average (length weighted) fibre length was measured with the Kajaani FS-100 fibre size analyzer.
[3]Produced according to the invention.
[4]Data taken from Table 2.

The level of energy saving for $TMP_{HP1FeEDTA}$ is the same as for $TMP_{HP1Fe}$, i.e. about 20% when compared to the energy consumption of the references ($TMP_{Ref1}$ and $TMP_{Ref2}$). In the ($TMP_{HP1FeEDTA}$ experiments the strength properties (i.e. tensile index and TEA) are, however, improved or strongly improved compared to the $TMP_{Ref1}$, and improved compared to $TMP_{HP1Fe}$ (cf. Tables 3 and 4). The light scattering ability, an important parameter for printing papers, is maintained at the same level as for the references ($TMP_{Ref1}$ and $TMP_{Ref2}$). The fibre length and width distributions were similar to those of the TMP references ($TMP_{Ref1}$ and $TMP_{Ref2}$, see FIGS. 2-3). This implies that the present invention strongly improves the energy efficiency and strength properties of the resulting pulp with maintained light scattering ability of the pulp.

EXAMPLE 3

Black spruce (*Picea mariana*) thermomechanical pulp (TMP) was debarked, chipped, preheated, and refined according to the procedure described in Example 1.

A reference TMP (denoted $TMP_{Ref1}$) was produced without addition of chemicals in the same manner as described in Example 1.

A TMP reference produced under more acidic conditions (denoted $TMP_{Ref2}$) was produced by adding 0.19 wt % (of bone dry wood) sulphuric acid ($H_2SO_4$) to the refiner eye (inlet) of the primary refiner in the same manner as described in Example 1.

A TMP produced according to the present invention using acid hydrogen peroxide ($H_2O_2$) was produced by adding 0.08 wt % iron sulfate ($FeSO_4 \times 7\ H_2O$) based on the weight of bone dry wood to the refiner eye of the primary refiner and 2.2 wt % hydrogen peroxide ($H_2O_2$) based on the weight of bone dry wood to the blow line of the primary refiner. The pH of the resulting pulp was 3.3. The pulp is denoted $TMP_{HP3Fe}$ in FIG. 5 and Tables 5-6.

A TMP produced according to the present invention using acid hydrogen peroxide ($H_2O_2$) was produced by adding 0.14 wt % iron sulfate ($FeSO_4 \times 7\ H_2O$) based on the weight of bone dry wood to the refiner eye of the primary refiner and 2.1 wt % hydrogen peroxide ($H_2O_2$) based on the weight of bone dry wood to the blow line of the primary refiner. The pH of the resulting pulp was 3.2. The pulp is denoted $TMP_{HP4Fe}$ in FIGS. 2-3 and 5 and Tables 5-6.

The degree of refining, measured as the freeness value of a pulp, is the most important parameter that influences pulp and paper properties such as strength and light scattering ability. It is therefore necessary to compare pulps at a constant freeness value. Both measured and interpolated values (to freeness 100 ml CSF) are thus provided in the tables below.

Figure 5:
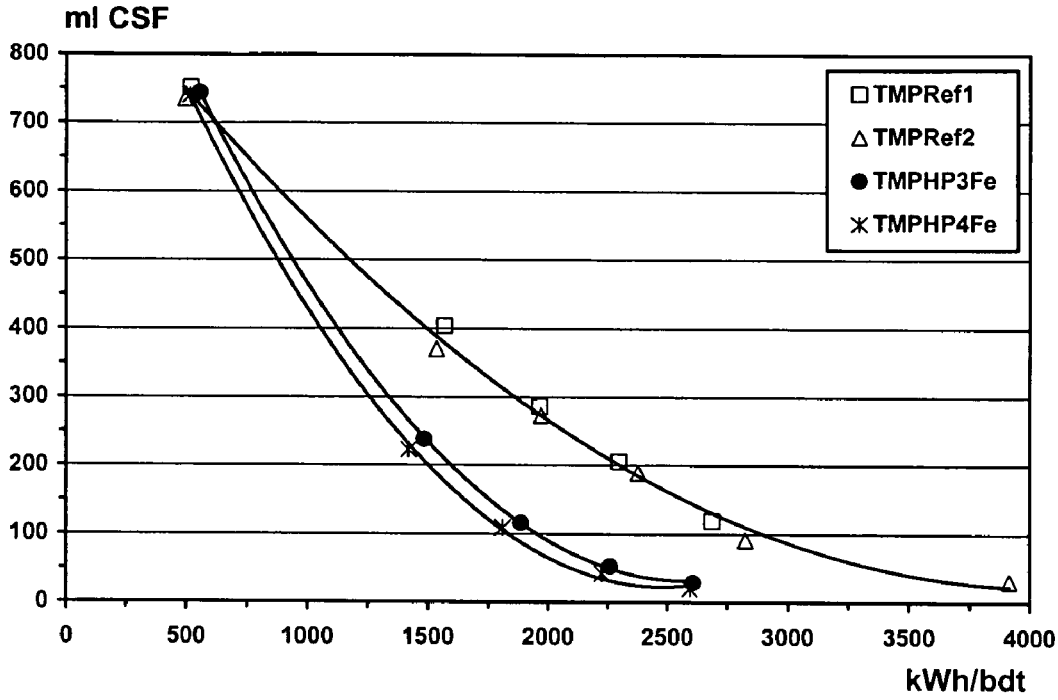

FIG. 5 illustrates freeness as a function of the specific energy consumption (SEC) for $TMP_{Ref1}$, $TMP_{Ref2}$ and the pulps produced according to the invention ($TMP_{HP3Fe}$ and $TMP_{HP4Fe}$). The pulps produced according to the described method consume 33% ($TMP_{HP3Fe}$) and 37% ($TMP_{HP4Fe}$) less energy to a constant freeness value (100 ml CSF) when compared to the energy consumption of the references ($TMP_{Ref1}$, $TMP_{Ref2}$).

TABLE 5

The pulp characteristics and energy consumption of the produced pulps

| | Freeness (ml CSF) | Energy cons. (kWh/bdt) | Tensile index (Nm/g) | Burst index ($kPam^2/g$) | TEA ($J/m^2$) | Fibre length[1] (mm) |
|---|---|---|---|---|---|---|
| $TMP_{Ref1}$ | 119 | 2687 | 42.4 | 2.6 | 30.4 | 1.6 |
| $TMP_{Ref2}$ | 91 | 2825 | 54.0 | 3.2 | 54.0 | 1.5 |
| $TMP_{HP3Fe}$[2] | 116 | 1885 | 47.1 | 2.4 | 40.3 | 1.6 |
| $TMP_{HP4Fe}$[2] | 109 | 1810 | 47.8 | 2.4 | 41.1 | 1.5 |

[1]The average (length weighted) fibre length was measured with the Kajaani FS-100 fibre size analyzer.
[2]Produced according to the invention.

TABLE 6

The pulp characteristics and energy savings of the produced pulps interpolated to a constant freeness value (100 ml CSF)

| | Energy saving[1] (%) | Tensile index (Nm/g) | Burst index ($kPam^2/g$) | TEA ($J/m^2$) | Fibre length[2] (mm) |
|---|---|---|---|---|---|
| $TMP_{Ref1}$ | | 49.5 | 2.7 | 32.3 | 1.6 |
| $TMP_{Ref2}$ | | 54.3 | 3.2 | 54.0 | 1.6 |

TABLE 6-continued

The pulp characteristics and energy savings of the produced pulps interpolated to a constant freeness value (100 ml CSF)

| | Energy saving[1] (%) | Tensile index (Nm/g) | Burst index ($kPam^2/g$) | TEA ($J/m^2$) | Fibre length[2] (mm) |
|---|---|---|---|---|---|
| $TMP_{HP3Fe}$[3] | 33 | 48.0 | 2.5 | 40.6 | 1.5 |
| $TMP_{HP4Fe}$[3] | 37 | 49.2 | 2.6 | 41.1 | 1.5 |

[1]The energy saving is given relative to the TMP references ($TMP_{Ref1}$ and $TMP_{Ref2}$).
[2]The average (length weighted) fibre length was measured with the Kajaani FS-100 fibre size analyzer.
[3]Produced according to the invention.

It is evident from FIG. 5 that an extensive energy saving of up to 37% (at a freeness level of 100 ml CSF) is possible to obtain with just over 2 wt % of hydrogen peroxide according to the procedure described in the invention. The strength properties (tensile index, TEA) of the resulting pulps are better than or equal to the strength properties of the $TMP_{Ref1}$ (cf. Tables 5-6), and no deterioration of the fibre length and fibre width characteristics was obtained (cf. FIGS. 2-3). The possibility to save this amount of electrical energy without loosing the strength properties of the resulting pulp is remarkable.

EXAMPLE 4

Norway spruce (*Picea abies*) wood was used for the production of thermomechanical pulp (TMP). The wood logs were debarked and chipped and washed prior to preheating and refining operations. A 20 inch pressurized refiner (model OVP-MEC run at 1500 rpm) was used to produce a high-freeness pulp (about 540 ml CSF). The energy input in the refiner was about 1150 kWh/bone dry metric ton (bdmt). The activator and oxidant were then added to the defibrated pulp in a mixer (Electrolux BM 10S) immediately before further refining in a Wing refiner. The activator was first added to the pulp followed by the addition of the oxidant. The mixing time was 30 seconds for both activator and oxidant. The reference pulp ($TMP_{Ref3}$) was treated in the same way with the exception that deionized water was added to the mixer to give the same pulp consistency as for the pulp treated according to the invention. This was done since it is well known that the pulp consistency influences the resulting pulp properties and refining energy consumption. The pulps were then transferred to the wing refiner for further treatment.

The wing refiner is a laboratory equipment that gives a higher energy consumption to a fixed freeness level due to its smaller size compared to a commercial refiner.

Each refining series described in the following examples was produced according to the procedure described above.

A TMP reference ($TMP_{Ref3}$) was produced without addition of chemicals as described above. The degree of refining (freeness) as a function of the specific energy consumption (SEC) can be seen in FIG. 6.

A TMP manufactured according to the present invention using acid hydrogen peroxide ($H_2O_2$) was produced by adding 0.13 wt % copper sulfate ($CuSO_4 \times 5\ H_2O$) based on the weight of bone dry wood and 2.0 wt % hydrogen peroxide ($H_2O_2$) based on the weight of bone dry wood to the high-freeness pulp. The pH of the resulting pulp was 3.5. The pulp is denoted $TMP_{HP5Cu}$ in FIG. 6.

Figure 6:
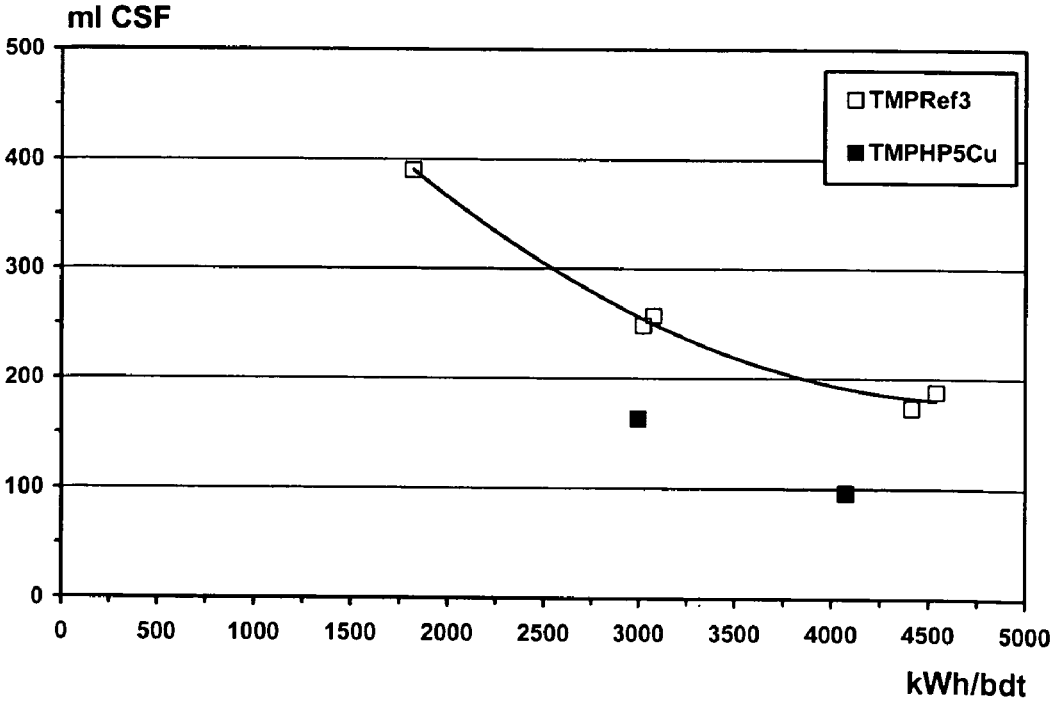

FIG. 6 illustrates the freeness as a function of the specific energy consumption (SEC) for the reference ($TMP_{Ref3}$) and the pulp produced according to the invention ($TMP_{HP5Cu}$). It is evident from FIG. 6 that a substantial energy saving is obtained for the pulp produced according to the invention. $TMP_{HP5Cu}$ consume 37% less energy to a constant freeness level (175 ml CSF) when compared to the energy consumption of the reference pulp ($TMP_{Ref3}$). The energy saving for $TMP_{HP5Cu}$ was obtained with 2.0 wt % (on bone dry wood) $H_2O_2$ and 0.13 wt % (on bone dry wood) $CuSO_4 \times 5\ H_2O$.

The average fibre length (at 175 ml CSF, measured with the Pulp Quality Monitor PQM 1000 instrument) was 1.7 mm for the reference ($TMP_{Ref3}$) and 1.8 mm for the pulp produced according to the invention ($TMP_{HP5Cu}$), i.e., no reduction in fibre length occurred.

Example 4 shows that substantially energy savings is obtained by using copper sulfate as activator and hydrogen peroxide as oxidant according to the method described in the invention.

EXAMPLE 5

Black spruce (*Picea mariana*) wood was used for the production of thermomechanical pulp (TMP). The wood logs were debarked and chipped and washed prior to preheating (4.14 bar steaming pressure, 40 s retention time) and refining operations. A single disc 36" pressurized refiner (model 36-1CP run at 1800 rpm) was used to produce a high-freeness pulp (about 750 ml CSF). The energy input in the refiner was about 500 kWh/bone dry metric ton (bdmt). The activator and oxidant were then added to the defibrated pulp in a mixer (Electrolux BM 10S) immediately before further refining in a Wing refiner. The activator was first added to the pulp followed by the addition of the oxidant. The mixing time was 30 seconds for both activator and oxidant. The reference pulp ($TMP_{Ref4}$) was treated in the same way with the exception that deionized water was added to the mixer to give the same pulp consistency as for the pulp treated according to the invention. This was done since it is well known that the pulp consistency influences the resulting pulp properties and refining energy consumption. The pulps were then transferred to the wing refiner for further treatment.

The wing refiner is a laboratory equipment that gives a higher energy consumption to a fixed freeness level due to its smaller size compared to a commercial refiner. It is well known that a smaller refiner has a higher energy consumption compared to a larger one.

Each refining series described in the following examples was produced according to the procedure described above.

A TMP reference ($TMP_{Ref4}$) was produced without addition of chemicals as described above. The degree of refining (freeness) as a function of the specific energy consumption (SEC) can be seen in FIG. 7.

A TMP produced by only adding an oxidant ($H_2O_2$) and no activator or enhancer was produced by adding 1.0 wt % hydrogen peroxide ($H_2O_2$) based on the weight of bone dry wood to the high-freeness pulp. The pH of the resulting pulp was 4.0. The pulp is denoted $TMP_{HPref}$ in FIG. 7.

A TMP manufactured according to the present invention using acid hydrogen peroxide ($H_2O_2$) was produced by adding 0.02 wt % iron sulfate ($FeSO_4 \times 7\ H_2O$) based on the weight of bone dry wood and 1.0 wt % hydrogen peroxide ($H_2O_2$) based on the weight of bone dry wood to the high-freeness pulp. The pH of the resulting pulp was 3.9. The pulp is denoted $TMP_{HP6Fe}$ in FIG. 7.

A TMP manufactured according to the present invention using acid hydrogen peroxide ($H_2O_2$) was produced by adding 0.08 wt % iron sulfate ($FeSO_4 \times 7\ H_2O$) based on the weight of bone dry wood and 1.0 wt % hydrogen peroxide ($H_2O_2$) based on the weight of bone dry wood to the high-freeness pulp. The pH of the resulting pulp was 3.8. The pulp is denoted $TMP_{HP7Fe}$ in FIG. 7.

A TMP manufactured according to the present invention using acid hydrogen peroxide ($H_2O_2$) was produced by adding 0.14 wt % iron sulfate ($FeSO_4 \times 7\ H_2O$) based on the weight of bone dry wood and 1.0 wt % hydrogen peroxide ($H_2O_2$) based on the weight of bone dry wood to the high-freeness pulp. The pH of the resulting pulp was 3.7. The pulp is denoted $TMP_{HP8Fe}$ in FIG. 7.

Figure 7:
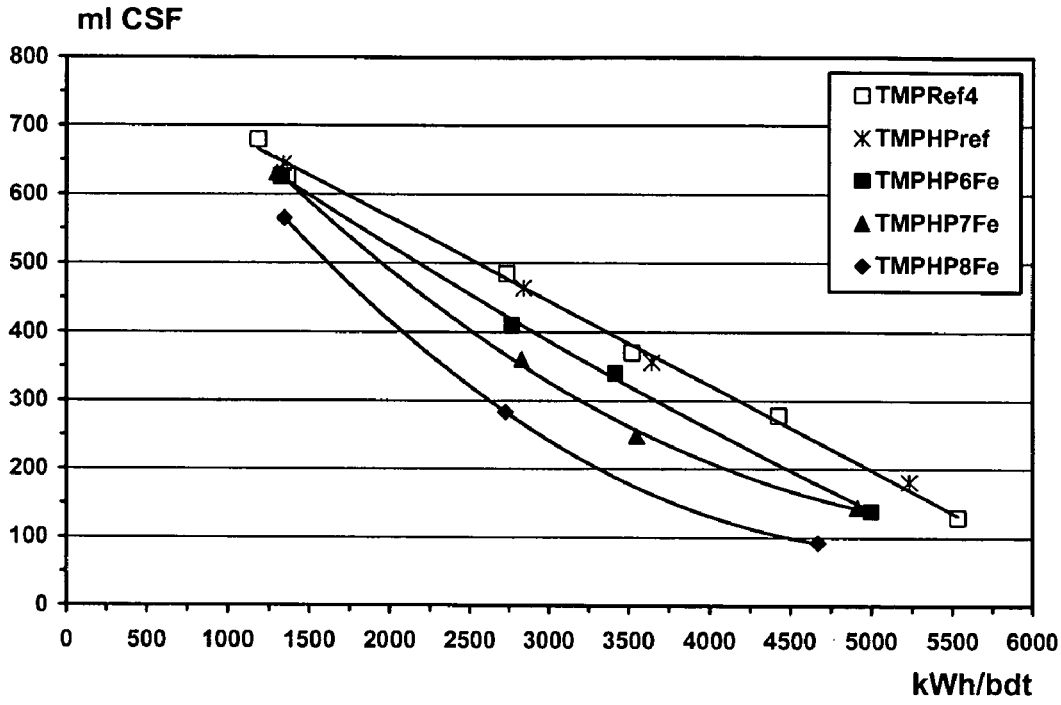

FIG. 7 illustrates the freeness as a function of the specific energy consumption (SEC) for the reference pulps ($TMP_{Ref4}$ and $TMP_{HPref}$) and the pulps produced according to the invention ($TMP_{HP6Fe}$, $TMP_{HP7Fe}$ and $TMP_{HP8Fe}$). It is evident from FIG. 7 that a substantial energy saving is obtained for the pulps produced according to the invention whereas no energy savings is obtained when only hydrogen peroxide (oxidant) is present ($TMP_{HPref}$). The pulp produced according to the invention consume 10% ($TMP_{HP6Fe}$), 15% ($TMP_{HP7Fe}$) and 33% ($TMP_{HP8Fe}$) less energy to a constant freeness level (175 ml CSF) when compared to the energy consumption of the reference pulps ($TMP_{Ref4}$ and $TMP_{HPref}$). The energy saving for $TMP_{HP6Fe}$ was obtained with 1.0 wt % (on bone dry wood) $H_2O_2$ and 0.02 wt % (on bone dry wood) $FeSO_4 \times 7\ H_2O$. For $TMP_{HP7Fe}$ and $TMP_{HP8Fe}$, the corresponding chemical additions were 1.0 wt % $H_2O_2$/0.08 wt % $FeSO_4 \times 7\ H_2O$ and 1.0 wt % $H_2O_2$/0.14 wt % $FeSO_4 \times 7\ H_2O$, respectively.

The average fibre length (at 175 ml CSF, measured with the Kajaani FS-100 fibre size analyzer) was 1.7 mm for the reference pulp $TMP_{Ref4}$ and 1.7 mm ($TMP_{HP6Fe}$), 1.7 mm ($TMP_{HP7Fe}$) and 1.6 mm ($TMP_{HP8Fe}$) for the pulps produced according to the invention. The average fibre length for $TMP_{HPref}$ was 1.8 mm. It is evident that no extensive fibre shortening occurs as a result of the chemical treatment described in this invention.

It is clear from the data presented in FIG. 7 and in the text above that addition of an oxidant alone, such as $H_2O_2$, is not enough to generate reduction in the refining energy consumption. An activator must thus be added, something that the method described in this invention stipulates.

EXAMPLE 6

Aspen (*Populus tremula*) wood was used for the production of chemithermomechanical pulp (CTMP). The wood logs were debarked and chipped and washed prior to preheating and refining operations. A 20 inch pressurized refiner (model OVP-MEC run at 1500 rpm) was used to produce a high-freeness pulp (about 420 ml CSF). The energy input in the refiner was about 1450 kWh/bone dry metric ton (bdmt). The activator and oxidant were then added to the defibrated pulp in a mixer (Electrolux BM 10S) immediately before further refining in a Wing refiner. The activator was first added to the pulp followed by the addition of the oxidant. The mixing time was 30 seconds for both activator and oxidant. The reference pulp ($CTMP_{Ref}$) was treated in the same way with the exception that deionized water was added to the mixer to give the same pulp consistency as for the pulp treated according to the invention. This was done since it is well known that the pulp consistency influences the resulting pulp properties and refining energy consumption. The pulps were then transferred to the wing refiner for further treatment.

The wing refiner is a laboratory equipment that gives a higher energy consumption to a fixed freeness level due to its smaller size compared to a commercial refiner. It is well known that a smaller refiner has a higher energy consumption compared to a larger one.

Each refining series described in the following examples was produced according to the procedure described above.

A TMP reference ($CTMP_{Ref}$) was produced without addition of chemicals as described above. The degree of refining (freeness) as a function of the specific energy consumption (SEC) can be seen in FIG. 8.

A CTMP manufactured according to the present invention using acid hydrogen peroxide ($H_2O_2$) was produced by adding 0.14 wt % iron sulfate ($FeSO_4 \times 7\ H_2O$) based on the weight of bone dry wood and 2.0 wt % hydrogen peroxide ($H_2O_2$) based on the weight of bone dry wood to the high-freeness pulp. The pH of the resulting pulp was 3.8. The pulp is denoted $CTMP_{HPFe}$ in FIG. 8.

Figure 8:
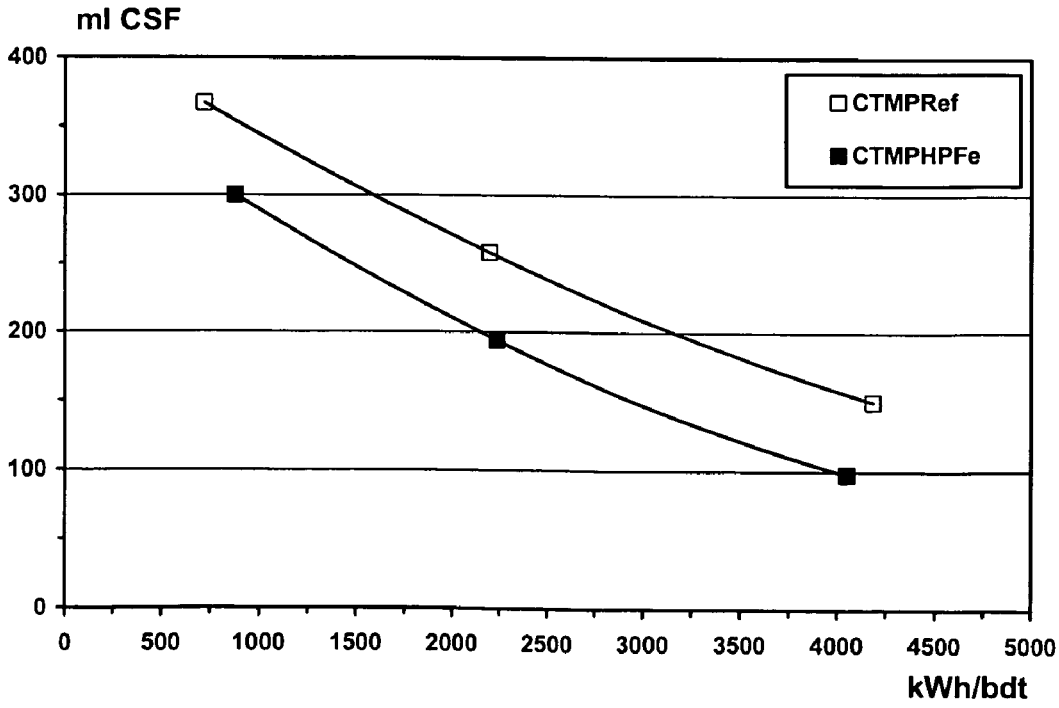

FIG. 8 illustrates the freeness as a function of the specific energy consumption (SEC) for the reference pulp ($CTMP_{Ref}$) and the pulp produced according to the invention ($CTMP_{HPFe}$). It is evident from FIG. 8 that a substantial energy saving is obtained for the pulp produced according to the invention. $CTMP_{HPFe}$ consume 32% less energy to a constant freeness level (175 ml CSF) when compared to the energy consumption of the reference pulp ($CTMP_{Ref}$). The energy saving for $CTMP_{HPFe}$ was obtained with 2.0 wt % (on bone dry wood) $H_2O_2$ and 0.14 wt % (on bone dry wood) $FeSO_4 \times 7\ H_2O$.

The average fibre length (at 175 ml CSF, measured with the Pulp Quality Monitor PQM 1000 instrument) was 0.95 mm for the reference pulp ($CTMP_{Ref}$) and 0.94 mm for the pulp produced according to the invention ($CTMP_{HPFe}$). It is evident that no fibre shortening occurs as a result of the chemical treatment described in this invention.

It is evident from the results presented in Example 6 that the method according to the invention also generates substantial energy savings for an aspen chemitermomechanical pulp without cutting the fibres during refining.

FIGURE DESIGNATIONS

In the attached figures, the following units and terms are being used:

FIGS. 1, 4-8: Freeness given in ml CSF (Canadian Standard Freeness) on the vertical Y-axis, SEC (Specific energy consumption) on the horizontal X-axis measured as kWh/bdt.

Figure 3:
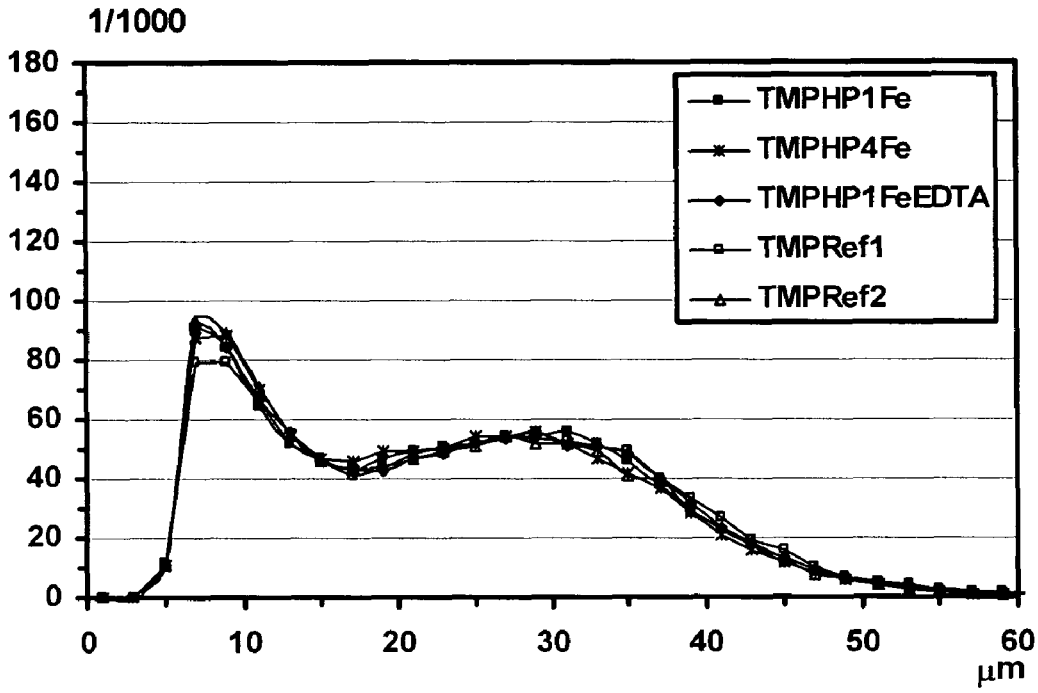

FIGS. 2 and 3: Proportion of the total length, 1/1000 on the vertical Y-axis, fiber length in mm (FIG. 2); fiber width in μm (FIG. 3) respectively on the horizontal X-axis.

The invention claimed is:

1. A process for preparing a high-yield pulp for papermaking selected from mechanical pulp (MP), refiner mechanical pulp (RMP), pressurized refiner mechanical pulp (PRMP), thermomechanical pulp (TMP), thermomechanical chemical pulp (TMCP), high-temperature TMP (HT-TMP) RTS-TMP, Thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW), chemimechanical pulp (CMP), chemirefinermechanical pulp (CRMP), chemithermomechanical pulp (CTMP), high-temperature CTMP (HT-CTMP), sulphite-modified thermomechanical pulp (SMTMP), reject CTMP ($CTMP_R$), groundwood CTMP (G-CTMP), high-yield sulphite pulp (HYS), biomechanical pulp (BRMP), pulps produced according to the OPCO process, Bi-Vis process, dilution water sulfonation process (DWS), sulfonated long fibres process (SLF), chemically treated long fibres process (CTLF), long fibre CMP process (LFCMP) or any modifications and combinations thereof comprising a) treating a lignocellulose containing material selected from wood particles and/or fibers chemically by means of an oxidising system comprising at least one non-enzymatic oxidant selected from inorganic or organic peroxy compounds or hydrogen peroxide generating compounds substantially free from ozone and chlorine dioxide in an amount from about 0.1 to about 5 wt % based on the weight of the lignocellulose containing material and an activator in an amount from about 0.0001 to about 1 wt % based on the weight of the lignocellulose containing material at a pH from about 2 to about 6.5; and b) treating the lignocellulose containing material mechanically in at least two or more stages for a time sufficient to produce a high-yield pulp, wherein the energy input to said at least two or more stages is at least 1150 kWh/bdmt and up to about 5000 kWh/bdmt, wherein the lignocellulose containing material is chemically treated by adding the non-enzymatic oxidant and activator to the lignocellulose containing material prior to and/or during any mechanical treatment stage, and wherein the lignocellulose containing material is not chemically treated at a pH from about 11.5 to about 14 between stages a) and b), wherein the activator is selected from transition metal ions and wherein the lignocellulosic containing material is treated at a temperature from 80 to 180° C.

2. A process according to claim 1, wherein the pH is from about 2.5 to about 6.

3. A process according to claim 1, wherein the pH is from about 3 to about 5.5.

4. A process according to claim 1 wherein the high-yield pulp is mechanical pulp, refiner mechanical pulp, groundwood pulp, chemimechanical pulp, semichemical pulp, thermomechanical and/or chemithermomechanical pulp.

5. A process according to claim 1, wherein said lignocellulose containing material comprises non-defibrated wood.

6. A process according to claim 1, wherein the lignocellulose containing material comprises mechanically treated lignocellulose containing material.

7. A process according to claim 1, wherein the oxidising system is applied between two mechanical treatment stages.

8. A process according to claim 1, wherein the lignocellulose containing material comprises softwood and/or hardwood.

9. A process according to claim 1, wherein the lignocellulose containing material comprises softwood.

10. A process according to claim 1, wherein the non-enzymatic oxidant is selected from peroxy compounds.

11. A process according claim 1, wherein the non-enzymatic oxidant is hydrogen peroxide.

12. A process according to claim 1, wherein the oxidising system comprises an activator selected from metal ions, TAED, cyanamide, or combinations thereof.

13. A process according to claim 1, wherein the oxidising system further comprises an enhancer selected from nitrogen-containing polycarboxylic acids, nitrogen-containing polyphosphonic acids, nitrogen-containing polyalcohols, oxalic acid, oxalate, glycolate, ascorbic acid, citric acid, nitrilo acetate, gallic acid, fulvic acid, itaconic acid, haemoglobin, hydroxybenzenes, catecholates, quinolines, dimethoxybenzoic acids, dihydroxybenzoic acids, dimethoxybenzylalcohols, pyridine, histidylglycine, phthalocyanine, acetonitril, 18-crown-6 ether, mercaptosuccinic acid, cyclohexadienes, polyoxomethalates, and combinations thereof.

14. A process according claim 1 wherein the oxidising system further comprises an enhancer selected from EDTA, DTPA, NTA, and combinations thereof.

15. The process of claim 1, wherein the non-enzymatic oxidant and activator are added to the lignocellulose containing material during at least one refining stage.

16. A process for preparing a high-yield pulp for papermaking selected from mechanical pulp (MP), refiner mechanical pulp (RMP), pressurized refiner mechanical pulp (PRMP), thermomechanical pulp (TMP), thermomechanical chemical pulp (TMCP), high-temperature TMP (HT-TMP) RTS-TMP, Thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW), chemimechanical pulp (CMP), chemirefinermechanical pulp (CRMP), chemithermomechanical pulp (CTMP), high-temperature CTMP (HT-CTMP), sulphite-modified thermomechanical pulp (SMTMP), reject CTMP ($CTMP_R$), groundwood CTMP (G-CTMP), high-yield sulphite pulp (HYS), biomechanical pulp (BRMP), pulps produced according to the OPCO process, Bi-Vis process, dilution water sulfonation process (DWS), sulfonated long fibres process (SLF), chemically treated long fibres process (CTLF), long fibre CMP process (LFCMP) or any modifications and combinations thereof comprising a) treating a lignocellulose containing material selected from wood particles and/or fibers chemically by means of an oxidising system comprising at least one non-enzymatic oxidant selected from inorganic or organic peroxy compounds or hydrogen peroxide generating compounds substantially free from ozone and chlorine dioxide in an amount from about 0.1 to about 5 wt % based on the weight of the lignocellulose containing material, an activator in an amount from about 0.0001 to about 0.1 wt % based on the weight of the lignocellulose containing material, and an enhancer selected from EDTA, DTPA, NTA, and combinations thereof in an amount from about 0.05 to about 0.3 wt % based on the weight of the lignocellulose containing material, at a pH from about 2 to about 6.5; and b) treating the lignocellulose containing material mechanically in at least two or more stages for a time sufficient to produce a high-yield pulp, wherein the energy input to said at least two stages is at least 1150 kWh/bdmt and up to about 5000 kWh/bdmt wherein the lignocellulose containing material is chemically treated by adding the non-enzymatic oxidant and activator to the lignocellulose containing material prior to and/or during any mechanical treatment stage, and wherein the lignocellulose containing material is not chemically treated at a pH from about 11.5 to about 14 between stages a) and b), wherein the activator is selected from transition metal ions, and wherein the lignocellulosic containing material is treated at a temperature from 80 to 180° C.

17. A process for preparing a high-yield pulp for papermaking selected from mechanical pulp (MP), refiner mechanical pulp (RMP), pressurized refiner mechanical pulp (PRMP), thermomechanical pulp (TMP), thermomechanical chemical pulp (TMCP), high-temperature TMP (HT-TMP) RTS-TMP, Thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW), chemimechanical pulp (CMP), chemirefinermechanical pulp (CRMP), chemithermomechanical pulp (CTMP), high-temperature CTMP (HT-CTMP), sulphite-modified thermomechanical pulp (SMTMP), reject CTMP ($CTMP_R$), groundwood CTMP (G-CTMP), high-yield sulphite pulp (HYS), biomechanical pulp (BRMP), pulps produced according to the OPCO process, Bi-Vis process, dilution water sulfonation process (DWS), sulfonated long fibres process (SLF), chemically treated long fibres process (CTLF), long fibre CMP process (LFCMP) or any modifications and combinations thereof comprising a) treating a lignocellulose containing material selected from wood particles and/or fibers chemically by means of an oxidising system comprising at least one non-enzymatic oxidant comprising hydrogen peroxide and being substantially free from ozone and chlorine dioxide in an amount from about 0.1 to about 5 wt % based on the weight of the lignocellulose containing material and an activator in an amount from about 0.0001 to about 1 wt % based on the weight of the lignocellulose containing material at a pH from about 2 to about 6.5; and b) treating the lignocellulose containing material mechanically in at least two or more stages for a time sufficient to produce a high-yield pulp wherein the energy input to said at least two stages is at least 1150 kWh/bdmt and up to about 5000 kWh/bdm, wherein the lignocellulose containing material is chemically treated by adding the non-enzymatic oxidant and activator to the lignocellulose containing material prior to and/or during any mechanical treatment stage, and wherein the lignocellulose containing material is not chemically treated at a pH from about 11.5 to about 14 between stages a) and b), wherein the activator is selected from transition metal ions, and wherein the lignocellulosic containing material is treated at a temperature from 80 to 180° C.

18. The process of claim 17, wherein the energy input is at least 1200 kWh/bdmt.

19. A process according to claim 17, wherein the non-enzymatic oxidant further comprises halogen containing oxidants, oxygen, nitrogen oxides, and combinations thereof.

* * * * *